US005086546A

United States Patent [19]

Aoki et al.

[11] Patent Number: 5,086,546

[45] Date of Patent: Feb. 11, 1992

[54] SLIDE FASTENERS SLIDER

[75] Inventors: Tsunetaka Aoki, Toyama; Susumu Ishii, Kurobe, both of Japan

[73] Assignee: Yoshida Kogyo K. K., Tokyo, Japan

[21] Appl. No.: 535,585

[22] Filed: Jun. 11, 1990

[30] Foreign Application Priority Data

Jun. 12, 1989 [JP] Japan ..... 1-68384[U]

[51] Int. Cl.[5] ..... A44B 19/26

[52] U.S. Cl. ..... 24/429

[58] Field of Search ..... 24/415, 435, 429, 431

[56] References Cited

U.S. PATENT DOCUMENTS

| | | | |
|---|---|---|---|
| 1,562,253 | 11/1925 | Prentice . | |
| 1,715,976 | 6/1929 | Baker . | |
| 2,171,455 | 8/1939 | Roadfuss . | |
| 2,185,853 | 1/1940 | Knoess | 24/429 |
| 2,233,661 | 3/1941 | Bugg . | |
| 2,316,133 | 4/1943 | Schaff | 24/429 |
| 2,328,882 | 8/1941 | Schaaff . | |
| 2,792,611 | 5/1957 | Morin | 24/429 X |
| 4,251,582 | 2/1981 | Bernier et al. | 24/415 X |
| 4,587,694 | 5/1986 | Asahi et al. | 24/435 |

FOREIGN PATENT DOCUMENTS

| | | |
|---|---|---|
| 1531615 | 7/1968 | France . |
| 63-234907 | 9/1988 | Japan . |

*Primary Examiner*—James R. Brittain

*Attorney, Agent, or Firm*—Hill, Van Santen, Steadman & Simpson

[57] ABSTRACT

A slider includes a slider body and a pull tab pivotally connected thereto. The slider body comprising a pair of upper and lower wings connected at their respective front ends by a diamond having a through hole formed longitudinally thereof, the upper wing having a recess in its upper surface close to the through hole; a holder post including a holder body and a crook portion bent rearwardly from the holder body; and a decorative pattern provided on the upper surface of the upper wing rearwardly of the recess. The holder body fits through the through hole and the crook portion has its lower end fit into the recess, thus defining with the upper surface of the upper wing an opening through which to pivotally join the pull tab to the slider body. The holder body is clinched to the slider body through the through hole.

8 Claims, 4 Drawing Sheets

SLIDE FASTENERS SLIDER

BACKGROUND OF THE INVENTION

1. Field of the Invention

The present invention generally relates to slide fastener sliders, and more particularly to a slide fastener slider of the type including a slider body having on its upper surface a decorative pattern.

2. Description of the prior art

In the fields of sportswears, high-grade baggages etc., it has been recently demanded that a decorative pattern be put on the upper surface of the upper wing of a slider used on these articles to meet the aesthetic desire of the purchasing public. Applying such a decorative pattern conspicuously on the upper wing naturally would entail rendering the smaller a post through which to attach the pull tab to the slider body. The pull-tab-attaching post could become about 1 mm thin so that the pull-tab-attaching post is very frangible. To make the matter worse, where the slider body and the pull-tab-attaching post are molded integrally to each other at one and the same time, molten metal has a difficulty in filling up that part of the mold cavity which corresponds to the thinned pull-tab-attaching post, so that the pull tab-attaching post is the more fragile due to deficient filling by the molten metal of the part of the cavity.

With the foregoing in view, there has been made one attempt to mold a slider body and a pull-tab-attaching post separately and to subsequently put them together. This attempt is disclosed in Japanese Patent Laid-open Publication No. 63-234907, although a slider according to this publication is not of the type of bearing a decorative pattern thereon. As shown in FIG. 7, the slider body A of this conventional slider comprises a pair of upper and lower wing D, D' joined at their front ends by a diamond B. The diamond B has an upwardly open blind hole C formed longitudinally thereof. The upper wing D has a recess E adjacent to its rear end. The slider body A further includes a pull tab holder G which serves to pivotally connect a pull tab (not shown) to the slider body A. The pull tab holder G comprises a holder body G1 and an inverted-flattened-U-shaped portion G2 which extends rearwardly from the upper end of the holder body G1 and terminates in a downwardly directed terminal portion G3. The slider body A yet further includes a substantially Z-shaped spring member I, which has its lower end I2 secured into the bore K formed adjacent to the bottom of the holder body G1 and has its upper end urged away from the holder body G1 under its own resiliency. Forcing the holder body G1 of the pull tab holder G into the blind hole C against the resiliency of the spring member I causes the upper end I1 of the spring member I to finally snap into the bore J of the inner periphery of the blind hole C, whereon the pull tab holder G is mounted on the slider body A with the terminal end portion G3 of the former urged into the recess E of the latter under the resiliency of the spring member I. Heretofore, there has been no such slider that has its upper wing provided with a decorative pattern.

This conventional slider, however, has suffered from the following drawbacks. If the holder post G were subjected to severe stresses during manipulation of the slider, such severe stresses would be prone to concentrate upon the spring member I, thereby damaging the spring member I, so that the holder post G and hence a pull tab would be very liable to detachment from the slider body A.

Furthermore, the slider body A, the holder post G and the spring member I are so complicated in construction for their sizes that it is very difficult not if impossible to use automatic assembling machines in order to put the slider together.

SUMMARY OF THE INVENTION

With the foregoing difficulties in view, it is therefore an object of the present invention to provide a slide fastener slider which has on its upper wing a decorative pattern.

It is another object of the present invention to provide a slide fastener slider wherein a holder post is firmly secured to a slider body so that a pull tab will be firmly joined with the slider body against accidental detachment therefrom.

It is still another object of the present invention to provide a slide fastener slider wherein a slider can be automatically assembled with automatic assembling machines.

According to the present invention, there is provided a slide fastener slider including a slider body and a pull tab pivotally connected thereto; the slider body comprising a pair of upper and lower wings connected at their respective front ends by a diamond having a through hole formed longitudinally thereof, the upper wing having a recess in its upper surface close to the through hole; a holder post including a holder body and a crook portion bent rearwardly from the holder body, the holder body being fit through the through hole and the crook portion having its lower end fit into the recess, thus defining with the upper surface of the upper wing an opening through which to pivotally join the pull tab to the slider body; means for clinching the holder body to the slider body through the through hole; and a decorative pattern provided on the upper surface of the upper wing rearwardly of the recess.

Many other advantages and features of the present invention will become manifest to those versed in the art upon making reference to the detailed description and the accompanying sheets of drawings in which preferred structural embodiments incorporating the principles of the present invention shown by way of illustrative example.

DETAILED DESCRIPTION

Figure 1:
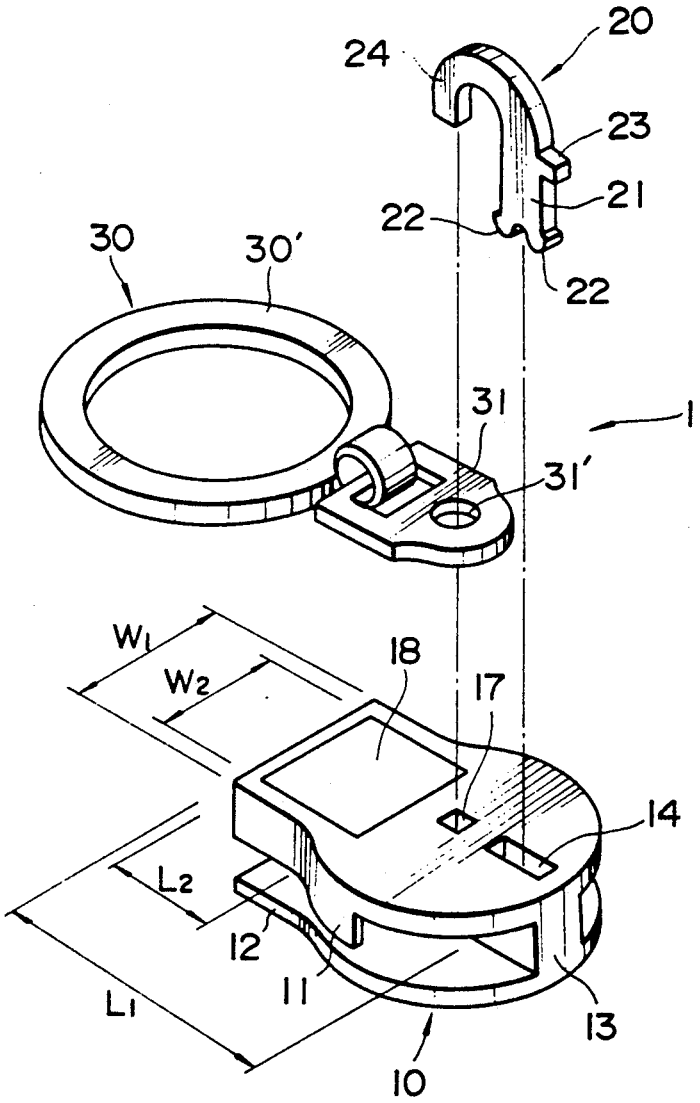
FIG. 1 is an exploded perspective view of a slide fastener slider according to the present invention.

As shown in FIG. 1, a slide fastener slider 1 according to the present invention broadly comprises a slider body 10 and a pull tab 30 pivotally connected thereto by a holder post 20 as described closely hereinafter. The slider body 10 generally comprises a pair of upper and lower wings 11, 12 connected at their respective front ends by a diamond 13 and a holder post 20 mounted on the slider body 10 as described closely hereafter.

The pull tab 30 includes a pull tab proper 30' adapted to be pulled for manipulation of the slider 1 and a pull tab support 31 adapted to connect the pull tab proper 30' to the slider body 10 and having a circular hole 31' therein for receiving a crook portion 24 of the holder post 20, as clearly set forth hereinafter.

Figure 2:
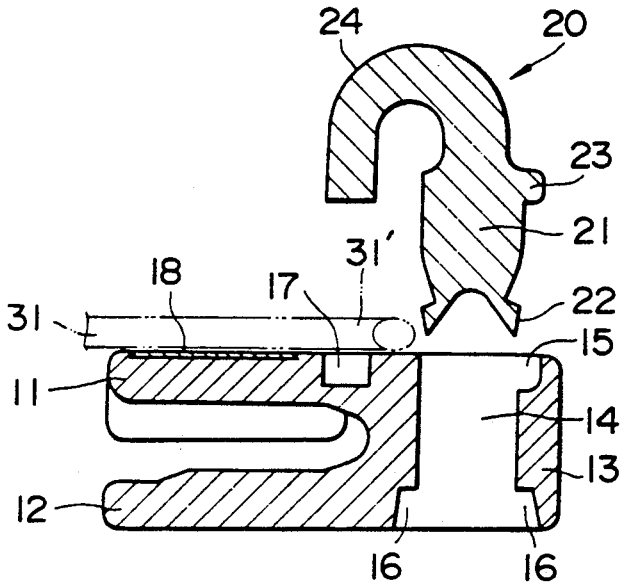
FIG. 2 is a longitudinal cross-section of the slide fastener slider of FIG. 1, showing it to assume a disposition before a holder post is joined to a slider body.

As better shown in FIG. 2, the diamond 13 has a through hole 14 of the rectangular cross-section formed longitudinally thereof. A furrow 15 is formed contiguously to the front upper edge of the through hole 14. A pair of steps 16, 16 are formed one in each of the opposed front and rear lower edges of the through hole 14. The upper wing 11 has a recess 17 formed in its upper surface close to and rearwardly of the through hole 14. The upper wing 11 also has a decorative pattern 18 glued, stamped or applied otherwise onto its upper surface rearwardly of the recess 17. The decorative pattern 18 may be diecasted while the slider body 10 is diecasted. As shown in FIG. 1, to ensure the decorativeness, the dimension of the decorative pattern 18 is determined such that the width W2 be not less than one fourth of the width W1 of the slider body 10 and the length L2 be one third through half of the length L1 of the slider body 10.

As better shown in FIGS. 1 and 2, the holder post 20 is in the form of a flat, thinned and hook-shaped plate and generally comprises a holder body 21 and a crook portion 24 bent arcuately rearwardly from the holder body 21. The holder body 21 has its lower end bifurcated to thus provide a pair of front and rear legs 22, 22. The holder body 21 also has at its upper end an abutment lug 23 projecting forwardly therefrom.

The slider body 10 may be made of zinc alloy, aluminium alloy, copper alloy, synthetic resin or so forth, while the holder post 20 may be made of brass, stainless steel, copper or so forth. The holder post 20 is made of material harder than that of the slider body 10 in order to endure severe external stresses although it is thinned.

Figure 3:
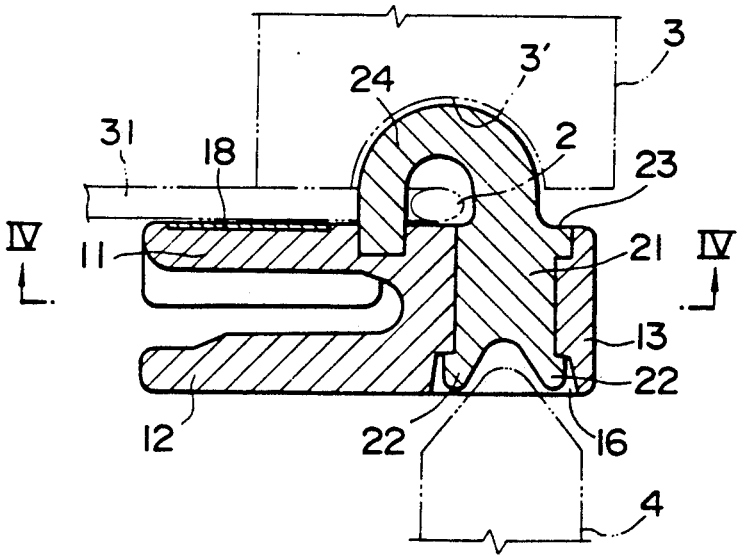
FIG. 3 is a view similar to FIG. 2 but showing the slider to assume a disposition after the holder post is joined to the slider body.
Figure 4:
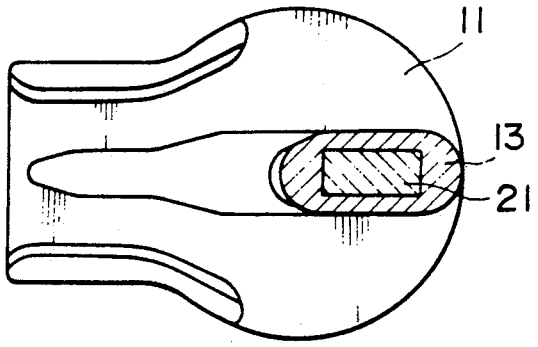
FIG. 4 is a cross-sectional view taken on line IV-IV of FIG. 3.

In assemblage, as shown in FIG. 2, first, the pull tab 30 is laid flat over the upper surface of the upper wing 11, with the circular hole 31' of the pull tab support 31 of the former held in registry with the recess 17 of the latter. In this disposition, the holder body 21 of the holder post 20 is inserted through the through hole 14 until the abutment lug 23 and the downwardly-directed end of the crook portion 24 comes into fitting engagement with the furrow 15 and the recess 17 through the circular hole 31', respectively, in the upper wing 11. In this instance, the legs 22, 22 extend beyond the opposed steps 16, 16. Thereafter, as shown in phantom lines in FIG. 3, a die 3 receives in its cavity 3' the crook portion 24 of the holder post 20 and then a pointed punch 4 presses the holder body 21 between the legs 22, 22, thus bending the legs 22, 22 outwardly into retentive engagement with the steps 16, 16. As a result, the holder post 20 is clinched to the slider body 10 and the crook portion 24 has its lower end securely fit into the recess 17, thus defining with the upper surface of the upper wing 11 an opening 2, through which the pull support 31 is pivotally joined to the crook portion 24.

Figure 5:
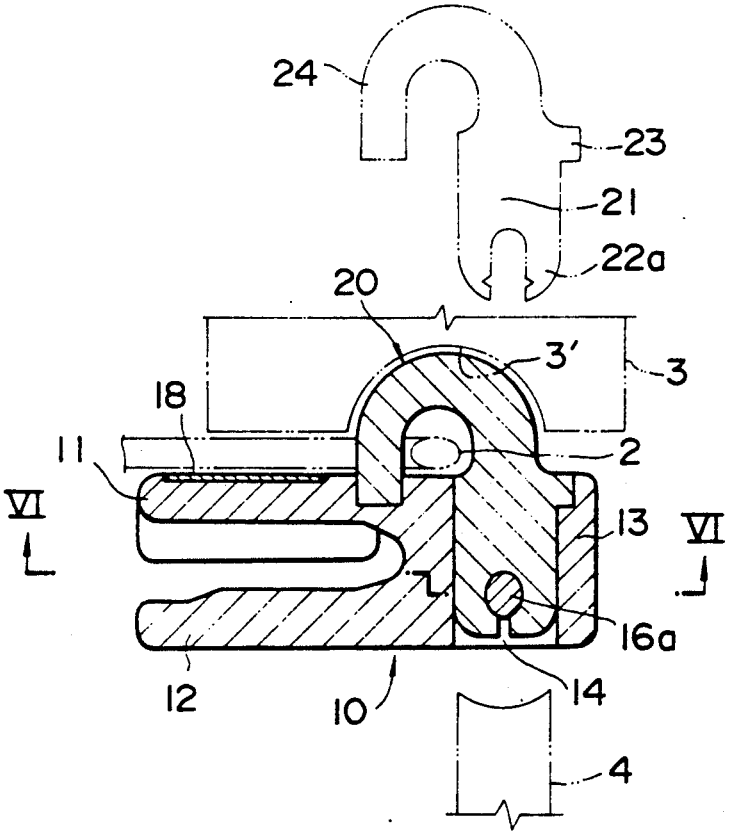
FIG. 5 is a fragmentary longitudinal cross-sectional view of a slide fastener slider according to a second embodiment of the present invention.
Figure 6:
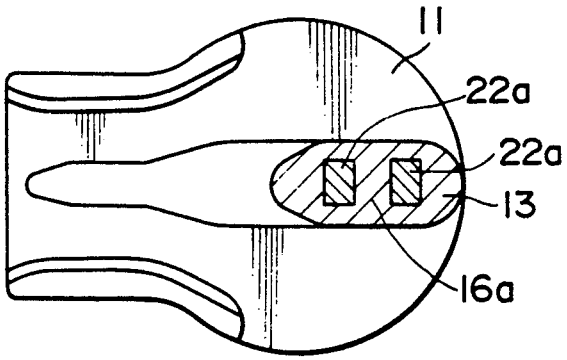
FIG. 6 is a cross-sectional taken on line VI—VI of FIG. 5.
Figure 7:
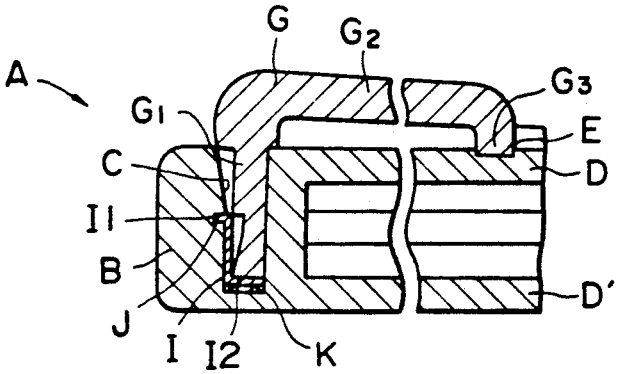
FIG. 7 PRIOR ART
FIG. 7 is a fragmentary cross-sectional view of a slide fastener slider according to the prior art.

FIGS. 5 and 6 show another embodiment which is substantially identical with the preceding embodiment with an exception that, instead of the steps 16, 16, a cross beam **16*a* is formed across the through hole 14 adjacent to its lower end so as to extend normal to the longitudinal axis of the slider body 10. The holder body 21 of the holder post 20 is inserted through the through hole 14 of the slider body 10 with a pair of legs 22*a*, 22*a* astriding the cross beam 16*a*. Then, the legs 22*a*, 22*a* are bent inwardly, instead of being bent outwardly, by a punch 4, to thus embrace the cross beam 16*a* therebetween so that the holder body 21 comes into clinching engagement with the slider body 10. In this embodiment, the punch 4 presses the legs 22*a*, 22*a* against the cross beam 16*a*, thus never applying a direct impact upon the slider body 10, so that the slider body 10 is immune from being damaged by the punch 4**.

As set forth hereinabove, since made as a part separate from the slider body, the holder post can be made less in size to thus leave on the upper surface of the slider body an ample space for a decorative pattern. Additionally, albeit being compact, the holder post enjoys mechanical strength enough to firmly join the pull tab to the slider body.

Furthermore, the holder post and the slider body are simple in construction so that automatics can be used in assemblage of this slider.

Still furthermore, since the end of the crook portion and the abutting lug of the holder post are snugly fitted into the recess and the furrow, respectively, in the slider body; even if there arose a slight gap between the holder body and the through hole, the holder post could be firmly secured to the slider body against jolting or displacement relative thereto.

Obviously, various modifications and variations of the present invention are possible in the light of the above teaching. It is therefore to be understood that within the scope of the appended claims the invention may be practiced otherwise than as specifically described.

What is claimed is:

1. A slide fastener including a slider body and a pull tab pivotally connected thereto;

the slider body comprising a pair of upper and lower wings connected at their respective front ends by a diamond having a through hole formed longitudinally thereof, the upper wind having a recess in its upper surface close to the through hole;

a holder post including a holder body and a crook portion bent rearwardly from the holder body, the holder body being fit through the through hole and the crook portion having its lower end fit into the recess, thus defining with the upper surface of the upper wing an opening through which to pivotally join the pull tab to the slider body;

means for clinching the holder body to the slider body through the through hole, the means for clinching comprising a cross beam formed across the through hole adjacent to its lower end and a pair of legs provided at the lower end of the holder body and bent inwardly into embracing engagement with the cross beam; and a decorative pattern provided on the upper surface of the upper wing rearwardly of the recess.

2. A slide fastener slider according to claim 1, wherein the holder body has on its upper end an abutment lug projecting laterally thereof, and the through hole has at its upper edge a furrow into which the abutment lug snugly fits.

3. A slide fastener slider including a slider body and a pull tab pivotally connected thereto;

the slider body comprising a pair of upper and lower wings connected at their respective front ends by a diamond having a through hole formed longitudinally thereof, the upper wing having a recess in its upper surface close to the through hole;

a holder post including a holder body and a crook portion bent rearwardly from the holder body, the holder body being fit through the through hole and the crook portion having its lower end fit into the recess, thus defining with the upper surface of the upper wing an opening through which to pivotally join the pull tab to the slider body, the holder body having on its upper end an abutment lug projecting laterally thereof, the through hole having at its upper edge a furrow into which the abutment lug is snugly fit;

means for clinching the holder body to the slider body through the through hole; and a decorative pattern provided on the upper surface of the upper wing rearwardly of the recess.

4. A slide fastener slider including a slider body and a pull tab pivotally connected thereto;

the slider body comprising a pair of upper and lower wings connected at their respective front ends by a diamond having a through hole formed longitudinally thereof, the upper wind having a recess in its upper surface close to the through hole;

a holder post including a holder body and a crook portion bent rearwardly from the holder body, the holder body being fit through the through hole and the crook portion having its lower end fit into the recess, thus defining with the upper surface of the upper wing an opening through which to pivotally join the pull tab to the slider body, wherein the holder body has on its upper end an abutment lug projecting laterally thereof, and the through hole has at its upper edge a furrow into which the abutment lug snugly fits;

means for clinching the holder body to the slider body through the through hole, the means for clinching comprising a pair of steps formed one in each of opposed lower edges of the through hole and a pair of legs provided at the lower end of the holder body and bent outwardly into retentive engagement with the steps; and a decorative pattern provided on the upper surface of the upper wing rearwardly of the recess.

5. A slide fastener slider including a slider body and a pull tab pivotally connected thereto;

the slider body comprising a pair of upper and lower wings connected at their respective front ends by a diamond having a through hole formed longitudinally thereof, the upper wind having a recess in its upper surface close to the through hole;

a holder post including a holder body and a crook portion bent rearwardly from the holder body, the holder body being fit through the through hole and the crook portion having its lower end fit into the recess, thus defining with the upper surface of the upper wing an opening through which to pivotally join the pull tab to the slider body; and means for clinching the holder body to the slider body through the through hole, the means for clinching comprising a cross beam formed across the through hole adjacent to its lower end and a pair of legs provided at the lower end of the holder body and bent inwardly into embracing engagement with the cross beam.

6. A slide fastener slide according to claim 5, wherein the holder body has on its upper end an abutment lug projecting laterally thereof, and the through hole has as its upper edge a furrow into which the abutment lug snugly fits.

7. A slide fastener slider including a slider body and a pull tab pivotally connected thereto;

the slider body comprising a pair of upper and lower wings connected at their respective front ends by a diamond having a through hole formed longitudinally thereof, the upper wing having a recess in its upper surface close to the through hole;

a holder post including a holder body and a crook portion bent rearwardly from the holder body, the holder body being fit through the through hole and the crook portion having its lower end fit into the recess, thus defining with the upper surface of the upper wing an opening through which to pivotally join the pull tab to the slider body, wherein the holder body has on its upper end an abutment lug projecting laterally thereof, and the through hole has at its upper edge a furrow into which the abutment lug snugly fits; and means for clinching the holder body to the slider body through the through hole, the means for clinching comprising a pair of steps formed one in each of opposed lower edges of the through hole and a pair of legs provided at the upper end of the holder body and bent outwardly into retentive engagement with the steps.

8. A slide fastener slider including a slider body and a pull tab pivotally connected thereto;

the slider body comprising a pair of upper and lower wings connected at their respective front ends by a diamond having a through hole formed longitudinally thereof, the upper wind having a recess in its upper surface close to the through hole; and a holder post including a holder body and a crook portion bent rearwardly from the holder body, the holder body being fit through the through hole and the crook portion having its lower end fit into the recess, thus defining with the upper surface of the upper wing an opening through which to pivotally join the pull tab to the slider body, wherein the holder body has on its upper end an abutment lug projecting laterally thereof, the through hole having at its upper edge a furrow into which the abutment lug is snugly fit.

* * * * *